US008408395B2

(12) United States Patent
Domke et al.

(10) Patent No.: US 8,408,395 B2
(45) Date of Patent: Apr. 2, 2013

(54) PROCESS FOR THE BENEFICIATION OF ORES BY MEANS OF HYDROPHOBIC SURFACES

(75) Inventors: Imme Domke, Mannheim (DE); Alexej Michailovski, Mannheim (DE); Hartmut Hibst, Schriesheim (DE)

(73) Assignee: BASF SE, Ludwigshafen (DE)

( * ) Notice: Subject to any disclaimer, the term of this patent is extended or adjusted under 35 U.S.C. 154(b) by 385 days.

(21) Appl. No.: 12/669,383

(22) PCT Filed: Jul. 8, 2008

(86) PCT No.: PCT/EP2008/058854

§ 371 (c)(1),
(2), (4) Date: Apr. 23, 2010

(87) PCT Pub. No.: WO2009/010422

PCT Pub. Date: Jan. 22, 2009

(65) Prior Publication Data

US 2010/0200510 A1 Aug. 12, 2010

(30) Foreign Application Priority Data

Jul. 17, 2007 (EP) ..... 07112607

(51) Int. Cl.
*B03B 1/00* (2006.01)

(52) U.S. Cl. ..... 209/9; 209/47; 209/49; 210/679

(58) Field of Classification Search ..... 209/9, 46, 209/47, 49, 63; 210/679, 783
See application file for complete search history.

(56) References Cited

U.S. PATENT DOCUMENTS

| | | | | |
|---|---|---|---|---|
| 92,893 | A * | 7/1869 | Smith | 209/44 |
| 2,189,698 | A * | 2/1940 | Bierbrauer | 209/49 |
| 3,796,308 | A * | 3/1974 | McIlhinney et al. | 209/9 |
| 3,822,014 | A * | 7/1974 | Verheyden et al. | 209/166 |
| 4,224,138 | A * | 9/1980 | Kruyer | 208/391 |
| 4,236,995 | A * | 12/1980 | Kruyer | 208/391 |
| 4,269,699 | A * | 5/1981 | McCready et al. | 75/770 |
| 4,657,666 | A | 4/1987 | Snook et al. | |
| 4,906,382 | A | 3/1990 | Hwang | |
| 5,161,694 | A * | 11/1992 | Yoon et al. | 209/5 |
| 7,759,123 | B2 * | 7/2010 | Call et al. | 436/53 |

(Continued)

FOREIGN PATENT DOCUMENTS

| | | |
|---|---|---|
| DE | 195 14 515 | 11/1996 |
| EP | 0 869 218 | 10/1998 |

(Continued)

*Primary Examiner* — Joseph C Rodriguez
(74) *Attorney, Agent, or Firm* — Oblon, Spivak, McClelland, Maier & Neustadt, L.L.P.

(57) ABSTRACT

A process for separating at least one hydrophobic material from a mixture comprising this at least one hydrophobic material and at least one hydrophilic material, which comprises the steps:

Figure 1:
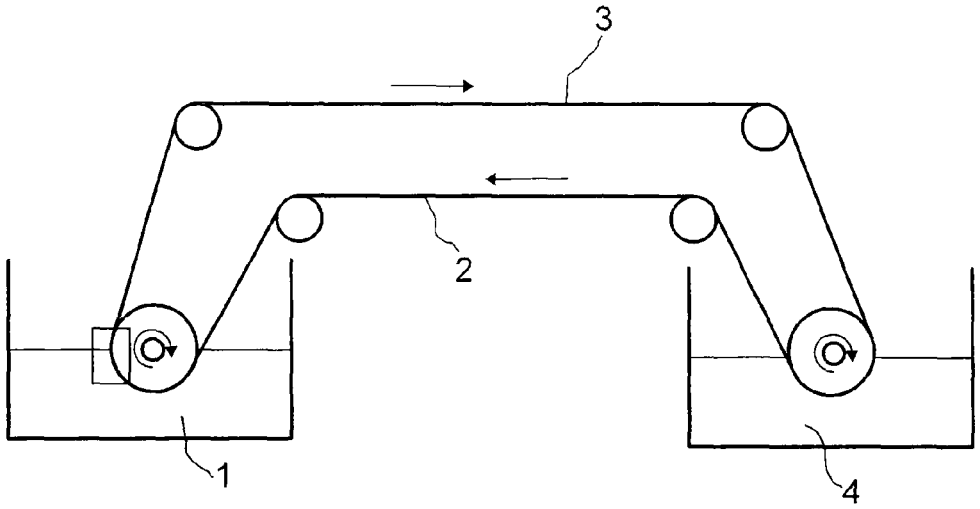

(A) preparation of a slurry or dispersion of the mixture to be treated in at least one suitable dispersion medium, (B) contacting of the slurry or dispersion from step (A) with at least one solid, hydrophobic surface to bind the at least one hydrophobic material to be separated off to this, (C) removal of the at least one solid, hydrophobic surface to which the at least one hydrophobic material is bound from step (B) from the slurry or dispersion in which the at least one hydrophilic material is comprised and (D) separation of the at least one hydrophobic material from the solid, hydrophobic surface.

14 Claims, 1 Drawing Sheet

U.S. PATENT DOCUMENTS

| | | | |
|---|---|---|---|
| 2011/0120954 | A1 | 5/2011 | Domke et al. |
| 2012/0000857 | A1 | 1/2012 | Domke et al. |

FOREIGN PATENT DOCUMENTS

| | | |
|---|---|---|
| JP | 58-501759 | 10/1983 |
| JP | 7-256251 | 10/1995 |
| JP | 7-275856 | 10/1995 |
| JP | 7-276792 | 10/1995 |
| SU | 544464 | 2/1977 |

* cited by examiner

PROCESS FOR THE BENEFICIATION OF ORES BY MEANS OF HYDROPHOBIC SURFACES

The present invention relates to a process for separating at least one hydrophobic material from a mixture comprising this at least one hydrophobic material and at least one hydrophilic material, and also to the use of a solid, hydrophobic surface for separating at least one hydrophobic material from the abovementioned mixture.

In particular, the invention comprises the separation of hydrophobic metal compounds, for example metal sulfides, from a mixture of these hydrophobic metal compounds and hydrophilic metal oxides for the beneficiation of ores by means of a hydrophobic surface.

At present, 90% of all lead, zinc and copper ores are concentrated by flotation. Flotation is a separation process in which materials dispersed or suspended in water are transported to the water surface by adhering gas bubbles and are removed there by means of a clearing device. Here, air is introduced into and finely dispersed in the flotation bath. The hydrophobic particles, for example sulfidic ores, are not readily wetted by water and therefore adhere to the air bubbles. In this way, these particles are carried by the air bubbles to the surface of the flotation tank and can be scooped off with the foam. A disadvantage of this process is that the air bubbles frequently lose their ballast on their way upward. To achieve a satisfactory yield, chemical additives, for example xanthates, which make the ore particles more strongly hydrophobic are therefore added. In addition, the constant introduction of air is associated with a high hazard potential.

The abovementioned disadvantage can be circumvented by magnetic flotation. In this method, the sulfidic ore constituents are in principle coupled in a targeted way to magnetic particles. In a second step, a magnetic field is applied and the magnetic constituents comprising the desired ore constituents are separated in this way from the unmagnetized constituents.

For example, U.S. Pat. No. 4,657,666 describes a method of beneficiating ores in which the hydrophobic magnetic particle adheres in a targeted way to the hydrophobic, sulfidic ore. The magnetic particle is selected from among magnetite and other magnetic iron oxides which have previously been hydrophobicized by bonding to silanes. The desired sulfidic ore is hydrophobicized in a targeted manner using a mixture of flotation agents/collectors in the presence of the oxidic gangue. After separation of the adder of magnetic particle and desired ore from the oxidic gangue, the magnetic particle is separated from the desired ore by treatment with 50% strength by volume $H_2O_2$ solution.

U.S. Pat. No. 4,906,382 discloses a process for the beneficiation of sulfidic ores, in which these are stirred with magnetic pigments which have been modified by means of bifunctional molecules. One of the two functional groups adheres to the magnetic core. The magnetic particle can be reversibly agglomerated via the second functional group by varying the pH. The magnetic particles can be used for concentrating sulfidic ores.

DE 195 14 515 discloses a process for concentrating materials of value by means of magnetite or hematite particles. For this purpose, the magnetite or hematite particles are modified with carboxylic acids or functionalized alkanols.

A disadvantage of the processes for beneficiation of ores described in the prior art is the fact that high magnetic fields are required in order to separate the magnetized particles efficiently from the original mixture. Complicated, costly apparatuses are required for this purpose. Furthermore, it has to be ensured that the magnetic particle coupled to the desired ore remains stably attached during the flotation process and can be effectively separated off again after the separation.

It is therefore an object of the present invention to provide a process for separating hydrophobic materials efficiently and in high purity from a mixture comprising these hydrophobic materials and hydrophilic materials. A further object of the present invention is to provide a process of this type which avoids coupling of magnetizable particles to the hydrophobic constituents to be separated off and the use of a stream of air.

These objects are achieved by a process for separating at least one hydrophobic material from a mixture comprising this at least one hydrophobic material and at least one hydrophilic material, which comprises the steps:

(A) preparation of a slurry or dispersion of the mixture to be treated in at least one suitable dispersion medium, (B) contacting of the slurry or dispersion from step (A) with at least one solid, hydrophobic surface to bind the at least one hydrophobic material to be separated off to this, (C) removal of the at least one solid, hydrophobic surface to which the at least one hydrophobic material is bound from step (B) from the slurry or dispersion in which the at least one hydrophilic material is comprised and (D) separation of the at least one hydrophobic material from the solid, hydrophobic surface.

The process of the invention serves to separate at least one hydrophobic material from a mixture comprising this at least one hydrophobic material and at least one hydrophilic material.

For the purposes of the present invention, "hydrophobic" means that the corresponding surface can be intrinsically hydrophobic or can have been hydrophobicized after its production. It is also possible for an intrinsically hydrophobic surface to be additionally hydrophobicized.

In a preferred embodiment of the process of the invention, the at least one hydrophobic material is at least one hydrophobic metal compound or coal and the at least one hydrophilic material is preferably at least one hydrophilic metal compound.

According to the invention, the process serves, in particular, to separate sulfidic ores from a mixture comprising these sulfidic ores and at least one hydrophilic metal compound selected from the group consisting of oxidic metal compounds.

The at least one hydrophobic metal compound is thus preferably selected from the group consisting of sulfidic ores. The at least one hydrophilic metal compound is preferably selected from the group consisting of oxidic metal compounds.

Examples of sulfidic ores which can be used according to the invention are, for example, selected from the group of copper ores consisting of chalcopyrite (copper pyrite) $CuFeS_2$, bornite $Co_5FeS_4$, chalcocite (copper glance) $Cu_2S$ and mixtures thereof.

Suitable oxidic metal compounds which can be used according to the invention are preferably selected from the group consisting of silicon dioxide $SiO_2$, preferably hexagonal modifications, feldspars, for example albite $Ma(Si_3Al)O_8$, mica, for example muscovite $KAl_2[(OH,F)_2AlSi_3O_{10}]$, and mixtures thereof.

In the process of the invention, preference is accordingly given to using untreated ore mixtures which are obtained from deposits in mines.

In a preferred embodiment, an ore mixture which can be separated according to the invention is milled to a particle size of $\leqq 100$ μm, particularly preferably $\leqq 60$ μm, before the process of the invention. Preferred ore mixtures have a content of sulfidic minerals of at least 0.4% by weight, particularly preferably at least 10% by weight.

Examples of sulfidic minerals present in the ore mixtures which can be used according to the invention are those mentioned above. In addition, sulfides of metals other than copper, for example sulfides of lead, zinc, molybdenum, PbS, ZnS and/or $MoS_2$, can also be present in the ore mixtures. Furthermore, oxidic compounds of metals and semimetals, for example silicates or borates or other salts of metals and semimetals, for example phosphates, sulfates or carbonates, can be present in the ore mixtures to be treated according to the invention.

A typical ore mixture which can be separated by means of the process of the invention has the following composition: about 30% by weight of $SiO_2$, about 10% by weight of $Na(Si_3Al)O_8$, about 3% by weight of $Cu_2S$, about 1% by weight of $MoS_2$, balance oxides of chromium, iron, titanium and magnesium.

The individual steps of the process of the invention are described in detail below:

Step (A):

Step (A) of the process of the invention comprises the preparation of a slurry or dispersion of the mixture to be treated in at least one suitable solvent.

As suitable dispersion media, all dispersion media in which the mixtures to be treated are not completely soluble are suitable. Suitable dispersion media for preparing the slurry or dispersion in step (A) of the process of the invention are selected from the group consisting of water, water-soluble organic compounds and mixtures thereof.

In a particularly preferred embodiment, the dispersion medium in step (A) is water.

In general, the amount of dispersion medium can, according to the invention, be selected so that a slurry or dispersion which is readily stirrable and/or conveyable is obtained. In a preferred embodiment, the amount of mixture to be treated based on the total slurry or dispersion is up to 100% by weight, particularly preferably from 0.5 to 10% by weight, very particularly preferably from 1 to 5% by weight.

According to the invention, the slurry or dispersion can be prepared by all methods known to those skilled in the art. In a preferred embodiment, the mixture to be treated and the appropriate amount of dispersion medium or dispersion medium mixture are combined in a suitable reactor, for example a glass reactor, and stirred by means of apparatuses known to those skilled in the art, for example in a glass tank by means of a mechanical propeller stirrer.

In a further preferred embodiment of the process of the invention, at least one adhesion-improving substance can be additionally added to the mixture to be treated and the dispersion medium or dispersion medium mixture.

Examples of suitable adhesion-improving substances are long- and short-chain amines, ammonia, long-chain alkanes and long-chain, unbranched alcohols. In a particularly preferred embodiment, dodecylamine is added to the slurry or dispersion in an amount, based on the dry weight of ore and magnetic particles, of preferably from 0.1 to 0.5% by weight, particularly preferably 0.3% by weight.

The adhesion-improving substance which may be added if appropriate is generally added in an amount which is sufficient to ensure the adhesion-improving action of this substance. In a preferred embodiment, the at least one adhesion-improving substance is added in an amount of from 0.01 to 10% by weight, particularly preferably from 0.05 to 0.5% by weight, in each case based on the total slurry or dispersion.

In a particularly preferred embodiment, the at least one hydrophobic material present in the mixture is hydrophobicized by means of at least one substance before step (B) of the process of the invention.

The hydrophobicization of the at least one hydrophobic material, preferably the at least one hydrophobic metal compound, can be carried out before step (A), i.e. before the preparation of the slurry or dispersion of the mixture to be treated. However, it is also possible according to the invention for the hydrophobic material to be separated off to be hydrophobicized after preparation of the slurry or dispersion in step (A). In a preferred embodiment, the mixture to be treated is hydrophobicized by means of a suitable substance before step (A).

As hydrophobicizing substance, it is possible, according to the invention, to use all substances which are able to effect further hydrophobicization of the surface of the hydrophobic metal compound to be separated off. The hydrophobicizing reagent is generally made up of a radical and an anchor group, with the anchor group preferably having at least 1 to 3 reactive groups, particularly preferably three reactive groups, which interact(s) with the hydrophobic material to be separated off, preferably the hydrophobic metal compound to be separated off. Suitable anchor groups are phosphonic acid groups or thiol groups.

In a particularly preferred embodiment, the hydrophobicizing substances are selected from the group consisting of phosphorus-comprising compounds of the general formula (I)

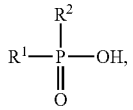

I where $R^1$ is hydrogen or a branched or unbranched $C_1$-$C_{20}$-alkyl radical, a $C_2$-$C_{20}$-alkenyl radical, a $C_5$-$C_{20}$-aryl radical or a heteroaryl radical, preferably a $C_2$-$C_{20}$-alkyl radical, and $R^2$ is hydrogen, OH or a branched or unbranched $C_1$-$C_{20}$-alkyl radical, a $C_2$-$C_{20}$-alkenyl radical, a $C_5$-$C_{20}$-aryl radical or a heteroaryl radical, preferably OH, sulfur-comprising compounds of the general formula (II)

$$R^3—S—R^4 \qquad \text{II,}$$

where $R^3$ is a branched or unbranched $C_1$-$C_{20}$-alkyl radical, a $C_2$-$C_{20}$-alkenyl radical, a $C_5$-$C_{20}$-aryl radical or a heteroaryl radical, preferably a $C_2$-$C_{20}$-alkyl radical, and $R^4$ is hydrogen or a branched or unbranched $C_1$-$C_{20}$-alkyl radical, a $C_2$-$C_{20}$-alkenyl radical, a $C_5$-$C_{20}$-aryl radical or a heteroaryl radical, preferably hydrogen, and mixtures thereof In a very particularly preferred embodiment, octylphosphonic acid is used, i.e. $R^1$ is a $C_8$-alkyl radical and $R^2$ is OH in the general formula (I).

These compounds having a hydrophobicizing action are added either individually or in admixture with one another in an amount of from 0.01 to 50% by weight, particularly preferably from 0.1 to 50% by weight, based on the mixture to be treated. These substances having a hydrophobicizing action can be applied to the hydrophobic material to be separated off, preferably the at least one metal compound to be separated off, by all methods known to those skilled in the art. In a preferred embodiment, the mixture to be treated is milled and/or stirred with the appropriate amount of hydrophobicizing substance, for example in a planetary ball mill. Suitable apparatuses are known to those skilled in the art.

Step (B):

Step (B) of the process of the invention comprises contacting of the slurry or dispersion from step (A) with at least one solid, hydrophobic surface to bind the at least one hydrophobic material to be separated off, preferably the at least one metal compound to be separated off, to the solid, hydrophobic surface.

For the purposes of the present invention, solid hydrophobic surface means that a surface which is hydrophobic and which either represents a one-piece surface, for example a plate or a conveyor belt, or represents the sum of the surfaces of many movable particles, for example the individual surfaces of a plurality of spheres, is used. Combinations of these embodiments are possible.

In the process of the invention, it is possible to use all solid, hydrophobic surfaces which are suitable for binding at least part of the hydrophobic material present in the mixture to be treated to this. The hydrophobic material is bound to the solid, hydrophobic surface by means of hydrophobic interactions.

In a preferred embodiment, the solid, hydrophobic surface is the interior wall of a tube, the surface of a plate, the fixed or movable surface of a conveyor belt, the interior wall of a reactor, the surface of three-dimensional bodies which are added to the slurry or dispersion. The solid, hydrophobic surface is particularly preferably the interior wall of a reactor or the fixed or movable hydrophobic surface of a conveyor belt having fibrous, micro-3D structures on the surface.

According to the invention, it is possible to use a solid, hydrophobic surface which is made intrinsically hydrophobic by the material which forms the solid, hydrophobic surface. However, it is also possible, according to the invention, for surfaces which are not intrinsically hydrophobic to be hydrophobicized by application of at least one hydrophobic layer.

In a preferred embodiment, a solid surface composed of metal, plastic, glass, wood or metal alloys is hydrophobicized by application of a hydrophobic compound which may, if appropriate, be surface-coated with suitable substances. This surface comprising hydrophobic compounds is, in an embodiment of the process of the invention, sufficiently hydrophobic in itself to be used in the process of the invention. The application of the hydrophobic layer can, for example, be effected by vapor deposition.

According to the invention, all hydrophobic materials which are known to those skilled in the art and are suitable for forming an appropriate hydrophobic layer can be used for forming this hydrophobic layer. A hydrophobic layer is a layer which has no polar groups and therefore has a water-repellent character.

Examples of suitable compounds are bifunctional compounds which adhere via one functional group to the solid surface by means of a covalent or coordinate bond and adhere via the other hydrophobic functional group to the desired ore by means of a covalent or coordinate bond. Examples of groups via which bonding to the inorganic compound occurs are the carboxyl group —COOH, the phosphonic acid group —$PO_3H_2$, the trihalosilyl group —$SiHal_3$ where the radicals Hal are each, independently of one another, F, Cl, Br, I, the trialkoxysilyl group —$Si(OR^5)_3$ where the radicals $R^5$ are each, independently of one another, $C_1$-$C_{12}$-alkyl and/or $C_2$-$C_{12}$-alkenyl.

Examples of groups via which bonding to the desired ore is effected are branched or unbranched $C_1$-$C_{20}$-alkyl groups, $C_5$-$C_{20}$-aryl groups and heteroaryl groups, compounds of the general formula (III)

$$—[CH_2]_n—X—C(=X)—X—R^6 \quad \text{(III)}$$

where n is from 1 to 25, the radicals X are each, independently of one another, S or O, and $R^6$ is a branched or unbranched $C_1$-$C_{10}$-alkyl radical, ammonium, a monovalent metal cation, for example an alkali metal cation.

If $R^6$ is ammonium or a monovalent metal cation, an ionic compound (III) in which the radical —$[CH_2]_n$—X—C(=X)—$X^-$ is singly negatively charged on the terminal X, with this charge being balanced by ammonium or the monovalent metal cation, is present.

Bonding to the desired ore preferably occurs via a group of the general formula (IIIa)

$$—[CH_2]_n—S—C(=S)—O—R^6 \quad \text{(IIIa)}$$

where n is from 2 to 20 and $R^6$ is a branched or unbranched $C_1$-$C_5$-alkyl radical.

In a further preferred embodiment, the solid, hydrophobic surface is the surface of a continuous conveyor belt which is moved through the slurry or dispersion comprising the mixture to be treated. The surface of the conveyor belt can, in a preferred embodiment, be increased by methods known to those skilled in the art, for example by applying a three-dimensional structure to the conveyor belt. An example of such a three-dimensional structure is fibres which are applied to the surface of the conveyor belt. The conveyor belt can be made of all suitable materials known to those skilled in the art, for example polymers such as polyethylene terephthalate, metallic materials such as aluminum, multicomponent materials such as aluminum alloys. The fibers can likewise be composed of all suitable materials known to those skilled in the art.

Step (C):

Step (C) of the process of the invention comprises removal of the at least one solid, hydrophobic surface to which the at least one hydrophobic material, preferably the at least one hydrophobic metal compound, is bound from step (B) from the slurry or dispersion in which the at least one hydrophilic material is comprised.

After contacting of the slurry or dispersion from step (A) with at least one solid, hydrophobic surface (B), the hydrophobic material to be separated off, preferably the hydrophobic metal compound to be separated off, is at least partly bound to the hydrophobic, solid surface. However, the hydrophilic material which is present in the mixture to be treated remains in the slurry or dispersion since this does not bind to the hydrophobic surface. It is thus possible to reduce the concentration of hydrophobic materials in the mixture to be treated by removal of these compounds with the hydrophobic surface.

The removal of the laden, hydrophobic, solid surface can be effected by all methods known to those skilled in the art. For example, a plate having the hydrophobic, solid surface can be lifted out of a bath comprising the slurry or dispersion. Furthermore, it is possible according to the invention for the hydrophobic, solid surface to be located on a conveyor belt which moves through the slurry or dispersion. If the hydrophobic, solid surface is located on the inside of a tube or a reactor, the slurry or dispersion is, in a preferred embodiment, passed through the reactor or through the tube. The removal of the solid, hydrophobic surface thus occurs as a result of the slurry or dispersion being conveyed past this surface. According to the invention, it is also possible, when the hydrophobic, solid surface is the interior wall of a reactor, for removal of this hydrophobic, solid surface to be achieved by the slurry or dispersion to be treated being drained from the reactor.

Step (D):

Step (D) comprises separation of the at least one hydrophobic material, preferably the at least one hydrophobic metal compound, from the solid, hydrophobic surface.

After step (C), the hydrophobic, solid surface is at least partly laden with the hydrophobic material to be separated off from the reaction mixture to be treated. To obtain the hydrophilic material to be separated off, it is necessary according to the invention to separate this hydrophobic material from the hydrophobic, solid surface.

This separation can be effected by all methods known to those skilled in the art which are suitable for separating the hydrophobic material from said surface without either the hydrophobic material and/or the surface being adversely affected.

In a preferred embodiment, the separation in step (D) of the process of the invention is effected by treating the solid, hydrophobic surface with a substance selected from the group consisting of organic solvents, basic compounds, acidic compounds, oxidants, surface-active compounds and mixtures thereof.

Examples of suitable organic solvents are methanol, ethanol, propanol, for example n-propanol or isopropanol, aromatic solvents, for example benzene, toluene, xylenes, ethers, for example diethyl ether, methyl t-butyl ether, and mixtures thereof. Examples of basic compounds which can be used according to the invention are aqueous solutions of basic compounds, for example aqueous solutions of alkali metal and/or alkaline earth metal hydroxides, for example KOH, NaOH, aqueous ammonia solutions, aqueous solutions of organic amines of the general formula $R^7{}_3N$, where $R^7$ is selected from the group consisting of $C_1$-$C_8$-alkyl, optionally substituted by further functional groups. The acidic compounds can be mineral acids, for example HCl, $H_2SO_4$, $HNO_3$ or mixtures thereof, organic acids, for example carboxylic acids. As oxidant, it is possible to use, for example, $H_2O_2$, for example as a 30% strength by weight aqueous solution (Perhydrol).

Examples of surface-active compounds which can be used according to the invention are nonionic, anionic, cationic and/or zwitterionic surfactants.

In a preferred embodiment, the hydrophobic, solid surface to which the hydrophobic material to be separated off is bound is washed with an organic solvent, particularly preferably acetone, to separate the hydrophobic material from the hydrophobic, solid surface. This procedure can also be supported mechanically. In a preferred embodiment, the organic solvent or another abovementioned separation reagent is applied under pressure to the hydrophobic surface which is laden with the hydrophobic desired ore. In a further preferred embodiment, it is possible for ultrasound to be used, if appropriate additionally, to aid the separation.

In general, the organic solvent is used in an amount which is sufficient to detach preferably the entire amount of the hydrophobic metal compounds adhering to the hydrophobic surface from the latter. In a preferred embodiment, from 20 to 100 ml of the organic solvent are used per gram of mixture of hydrophobic and hydrophilic material to be beneficiated. According to the invention, preference is given to the hydrophobic, solid surface being treated with a plurality of relatively small portions, for example two portions, of the organic solvent, which together make up the abovementioned total amount.

According to the invention, the hydrophobic material to be separated off is present as a slurry or dispersion in the organic solvent mentioned. The hydrophobic material can be separated from the organic solvent by all methods known to those skilled in the art, for example decantation, filtration, distillation of the organic solvent or sedimentation of the solid constituents at the bottom of the vessel, after which the ore can be scooped off at the bottom. The hydrophobic material to be separated off, preferably the hydrophobic metal compound to be separated off, is preferably separated from the organic solvent by filtration. The hydrophobic material which can be obtained in this way can be purified by further methods known to those skilled in the art. The solvent can, if appropriate after purification, be recirculated to the process of the invention.

In a further preferred embodiment, the hydrophobic, solid surface from which the hydrophobic material has been separated off in step (D) is dried. This drying can be effected by all methods known to those skilled in the art, for example by treatment at a temperature of, for example, from 30 to 100° C. in an oven.

In a further preferred embodiment, the hydrophobic, solid surface, which has been dried if appropriate, is recirculated to the process of the invention, i.e. reused in step (B) of the process of the invention. For example, when a conveyor belt is used, the process of the invention can be carried out with the conveyor belt being passed continuously through the slurry or dispersion to be treated, treated with a solvent to separate off the hydrophobic particles, dried and conveyed back into the bath to be treated. When recirculating the hydrophobic, solid surface, it is necessary according to the invention for this to have been freed completely of the separation reagent used.

The present invention also provides for the use of a solid, hydrophobic surface for separating at least one hydrophobic material, preferably a hydrophobic metal compound or coal, from a mixture comprising this at least one hydrophobic material and at least one hydrophilic material, preferably at least one hydrophilic metal compound.

As regards the solid, hydrophobic surface, the hydrophobic materials, the hydrophilic materials and the mixture comprising this at least one hydrophobic material and at least one hydrophilic material, what has been said in respect of the process of the invention applies.

FIGURES

FIG. 1 shows a particularly preferred embodiment of the process of the invention in which a continuous conveyor belt is used as hydrophobic solid surface. The reference numerals have the following meanings:

1 mixture to be separated comprising at least one hydrophobic material and at least one hydrophilic material

2 hydrophobic conveyor belt having a structured surface

3 hydrophobic conveyor belt with adhering hydrophobic material

4 separation agent, for example organic solvent

Figure 2:
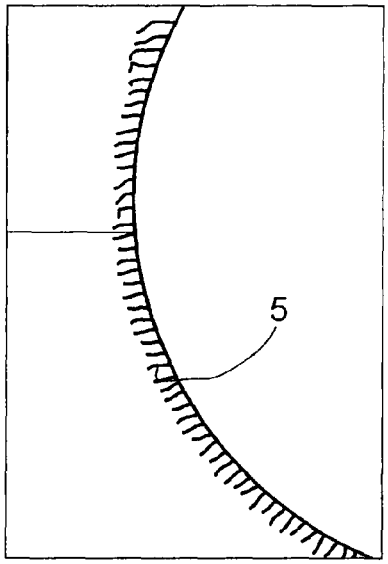

FIG. 2 shows an enlargement of a section of a conveyor belt in the mixture of at least one hydrophobic material and at least one hydrophilic material, with the following meaning

5 structures on the belt surface

EXAMPLE

A 100 ml glass beaker is coated with hydrophobicized magnetite (surface-coated with 1-dodecyltrichlorosilane, with 1 $nm^2$ of magnetite surface being laden with about 10-50 molecules of trichlorosilane; diameter of the magnetite particles=10 nm) so that an area of the walls of about 40 $cm^2$ is hydrophobicized. 50 ml of water, 0.05 g of dodecylamine (98% pure; Alfa Aesar), 0.50 g of $Cu_2S$, stirred with 1.7% by weight of octylphosphonic acid, and 0.50 g of sea sand, which consists of 100% of $SiO_2$ and has been cleaned by means of hydrochloric acid and stirred with 1.7% by weight of octylphosphonic acid, are introduced into the glass beaker which has been coated in this way. The mixture is stirred at 400 rpm for 2 hours, the water is subsequently carefully removed by means of suction and the contents of the glass beaker are carefully dried. The sand sitting on the bottom is taken out and recovered (0.46 g). 30 ml of acetone are subsequently introduced into the glass beaker and the mixture is stirred vigorously for 5 minutes. The acetone phase is subsequently decanted off and transferred to a second glass beaker. This procedure is repeated a second time. Filtration gives 0.38 g of $Cu_2S$.

The amount of $Cu_2S$ recovered corresponds to a relative amount of 76%.

The invention claimed is:

1. A process comprising separating at least one hydrophobic material from a mixture comprising the at least one hydrophobic material and at least one hydrophilic material, the process comprising:

(A) preparing a slurry or dispersion of the mixture to be treated in at least one suitable dispersion medium;

(B) contacting the slurry or dispersion from (A) with at least one solid, hydrophobic surface to bind the at least one hydrophobic material to be separated from the slurry or the dispersion, wherein the solid hydrophobic surface is an interior wall of a tube, a surface of a plate, a surface of a conveyor belt or an interior wall of a reactor;

(C) removing the at least one solid, hydrophobic surface to which the at least one hydrophobic material is bound in (B) from the slurry or dispersion comprising at least one hydrophilic material; and (D) separating the at least one hydrophobic material from the solid, hydrophobic surface, wherein the at least one hydrophobic material present in the mixture is hydrophobicized by at least one substance before carrying out (B), which is at least one substance is made up of a radical and an anchor group having 1 to 3 reactive groups which interact(s) with the hydrophobic material to be separated off.

2. The process according to claim 1, wherein the at least one hydrophobic material is at least one hydrophobic metal compound or coal and the at least one hydrophilic material is at least one hydrophilic metal compound.

3. The process according to claim 2, wherein the at least one hydrophobic metal compound is selected from the group consisting of sulfidic ores.

4. The process according to claim 2, wherein the at least one hydrophilic metal compound is selected from the group consisting of oxidic metal compounds.

5. The process according to claim 3, wherein the sulfidic ores are selected from the group consisting of chalcopyrite $CuFeS_2$, bornite $Cu_5FeS_4$, chalcocite $Cu_2S$ and mixtures thereof.

6. The process according to claim 4, wherein the oxidic metal compounds are selected from the group consisting of silicon dioxide $SiO_2$, feldspars, mica and mixtures thereof.

7. The process according to claim 1, wherein the dispersion medium in (A) is water.

8. The process according to claim 1, wherein the separation in (D) comprises treating the solid hydrophobic surface with a substance selected from the group consisting of organic solvents, basic compounds, acidic compounds, oxidants, surface-active compounds and mixtures thereof.

9. The process according to claim 1, wherein the solid, hydrophobic surface is, after carrying out (D), recirculated to (B).

10. The process according to claim 1, wherein the anchor group has 3 reactive groups.

11. The process according to claim 10, wherein the anchor groups are phosphonic acid groups or thiol groups.

12. The process according to claim 1, wherein the at least one substance is selected from the group consisting of a phosphorus-comprising compound of the general formula (I)

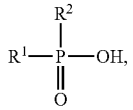

I wherein $R^1$ is hydrogen or a branched or unbranched $C_1$-$C_{20}$-alkyl radical, a $C_2$-$C_{20}$-alkenyl radical, a $C_5$-$C_{20}$-aryl radical or a heteroaryl radical, and $R^2$ is hydrogen, OH or a branched or unbranched $C_1$-$C_{20}$-alkyl radical, a $C_2$-$C_{20}$-alkenyl radical, a $C_5$-$C_{20}$-aryl radical or a heteroaryl radical, and a sulfur-comprising compound of the general formula (II)

$$R^3—S—R^4 \quad \text{II},$$

where $R^3$ is a branched or unbranched $C_1$-$C_{20}$-alkyl radical, a $C_2$-$C_{20}$-alkenyl radical, a $C_5$-$C_{20}$-aryl radical or a heteroaryl radical, and $R^4$ is hydrogen or a branched or unbranched $C_1$-$C_{20}$-alkyl radical, a $C_2$-$C_{20}$-alkenyl radical, a $C_5$-$C_{20}$-aryl radical or a heteroaryl radical, and mixtures thereof.

13. The process according to claim 12, wherein the at least one substance is said phosphorus-comprising compound, and wherein $R^1$ is a $C_8$-alkyl radical and $R^2$ is OH in general formula (I).

14. The process according to claim 12, wherein the at least one substance is said sulfur-comprising compound, and wherein $R^3$ is a $C_2$-$C_{20}$-alkyl radical and $R^4$ is hydrogen.

* * * * *